United States Patent [19]

Jones

[11] Patent Number: 4,833,948

[45] **Date of Patent: * May 30, 1989**

[54] KITCHEN APPLIANCE FOR REMOVING TWIST-OFF CAPS

[76] Inventor: William C. Jones, Bourbon Rd., R. R. 2, Box 152, Tuscola, Ill. 61953

[ * ]. Notice: The portion of the term of this patent subsequent to Jan. 12, 2005 has been disclaimed.

[21] Appl. No.: 142,730

[22] Filed: Jan. 11, 1988

Related U.S. Application Data

[63] Continuation-in-part of Ser. No. 819,818, Jan. 16, 1986, Pat. No. 4,718,312.

[51] Int. Cl.[4] ..... B67B 7/18

[52] U.S. Cl. ..... 81/3.2

[58] Field of Search ..... 81/3.2, 3.33, 3.4; 53/381 A

[56] References Cited

U.S. PATENT DOCUMENTS

| | | | |
|---|---|---|---|
| 3,048,068 | 8/1962 | Griffiths | 81/3.4 |
| 3,600,982 | 8/1971 | Tholen | 81/3.4 |
| 4,718,312 | 1/1988 | Jones | 81/3.2 |

*Primary Examiner*—Roscoe V. Parker

*Attorney, Agent, or Firm*—Grace J. Fishel

[57] ABSTRACT

A kitchen appliance for removing twist-off caps including an operator driven by a motor which is activated by a switch responsive to the user's holding a twist-off cap against the operator or releasing same therefrom, said operator including means for positively gripping and resisting removal of a cap pressed therein. Means for releasing a cap held in the operator are provided in a preferred embodiment and in a hand held version of the operator.

10 Claims, 3 Drawing Sheets

KITCHEN APPLIANCE FOR REMOVING TWIST-OFF CAPS

This application is a continuation-in-part of Ser. No. 819,818, filed Jan. 16, 1986 and now U.S. Pat. No. 4,718,312.

The present invention relates to an opener for opening twist-off caps on bottles, jars or the like.

More and more food, beverage, medicine, cosmetics and toiletries are coming in plastic bottles with twist-off caps and the number of glass containers for these items is similarly increasing. These facts are supported by figures compiled by the U.S. Department of Commerce.

There are many sizes and kinds of closures and bottles and jars come in many shapes and sizes. In the kitchen they range from a small vanilla jar with a five-eighths inch cap to a peanut butter jar with a four inch cap and include small medicine bottles and large three liter beverage bottles. Closures include pressure twist-off caps like that found on cheese spread, screw off caps like those found on mayonnaise jars, and depress and twist safety caps found on medicine bottles. Caps may be metal or plastic and have both smooth or serrated edges. Home canned products, syrup and honey jars are especially hard to open and then reopen after storage in the refrigerator. Most bottles and jars are made of plastic or glass which can be broken or cracked if the cap is hit with a hard object such as a hammer or by pounding it on the edge of a kitchen counter. In addition, many jars are filled with a liquid such as found in pickle and beet jars and care is needed when opening to prevent spilling.

Practically every housewife has difficulty opening jars and bottles. Many housewives have small hands and most housewives have hands that are not as strong as their husbands. There are about seventeen million adults in the United States alone with some degree of arthritis and there are also many people with other types of illness or injury that cause a decrease in hand strength. It is also a fact that our population is getting older and with age comes a decrease in strength and dexterity. In addition, the number of small electric appliances on the market shows that people like the convenience of such devices.

There are few hand operated openers on the market that are very effective and there are even fewer, if any, which are motorized. All devices for opening twist-off caps increase the amount of torque applied to opening a lid. Most of them include a jaw for gripping the twist-off cap connected to a handle for applying increased torque but the exact form of the jaw and of the handle differ widely. One difficulty with devices of this type is that the user must hold the vessel being opened with one hand while trying to manipulate the opener with the other. Included in this process is the problem of locking the jaw on the cap with one hand and the problem of gripping the vessel with sufficient force so that it does not turn with the cap. People with small hands or with physical disabilities such as arthritis find it particularly difficult to accomplish the above-mentioned operations.

There have been jar opening devices such as that described in U.S. Pat. No. 4,102,226 which address the problem of how to hold the container while operating the opener by providing clamps for clamping the vessel. These devices are operable but not practical in that it is too cumbersome to clamp the vessel before beginning the opening operation.

Another solution to the problem is offered by two companies who have added a mechanical wedge shaped device to their electric can openers but these openers are dangerous to use because a slip can cause the user to slice his hand on the blades making up the wedge. In addition, these openers do not hold the cap in the opener after it has been separated from the container.

In view of the above, there is a need for a motorized twist-off cap opener which allows the user to devote both hands to holding the vessel being opened such that the user can resist the force applied to the cap with both hands. There is also a need for a twist-off cap opener which holds the cap in the opener after it has been separated from the container and which can be engaged by simply pressing the ca into the opening device. It is therefore an object of the present invention to provide a motorized twist-off cap opener which has the above-mentioned features. Other objects and features of the invention will be in part apparent and in part pointed out hereinafter.

The invention accordingly comprises the constructions hereinafter described and equivalents thereof, the scope of the invention being indicated by the subjoined claims.

In the drawings in which one of several possible embodiments of the invention is illustrated, corresponding reference numerals refer to corresponding parts and in which.

Figure 1:
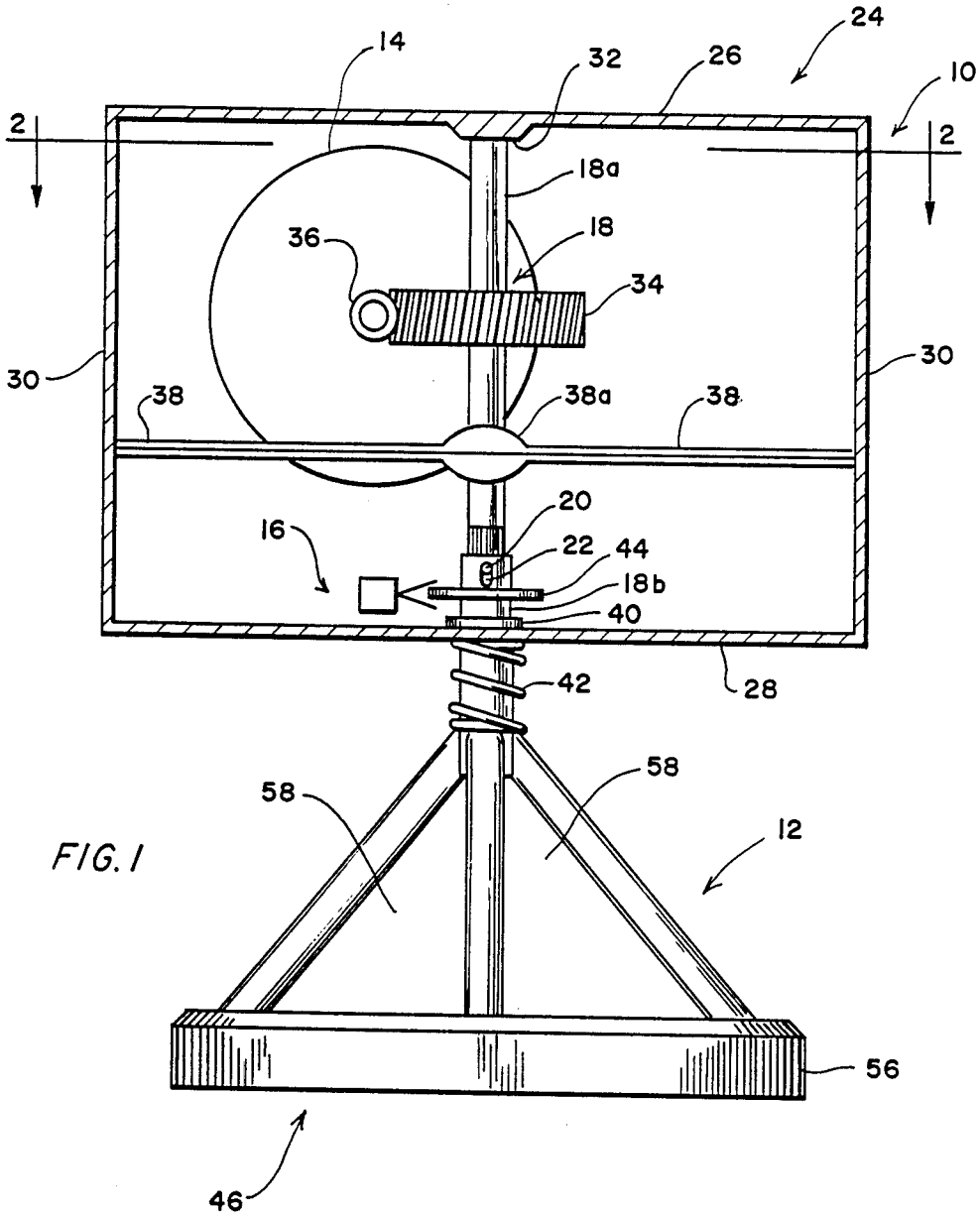
FIG. 1 is a front view, partly in section, of a motorized twist-off cap opener and an operator in accordance with the present invention.
Figure 2:
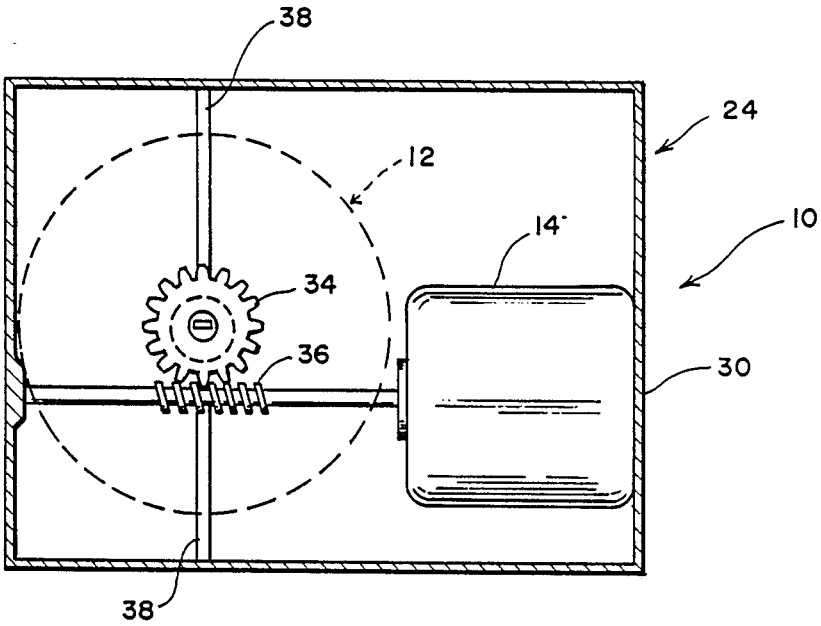
FIG. 2 is a top view of the opener taken along line 2—2 in FIG. 1.

Referring to the drawings more particularly by reference number, reference numeral 10 refers to a motorized twist-off cap opener in accordance with the present invention including an operator 12 driven by a motor 14 which is actuated by a switch 16 responsive to the user's holding a twist-off cap against the operator or releasing the same therefrom. While it is essential that there be an operator, motor and switch, the exact form of these elements is subject to wide variation. In the embodiment illustrated, operator 12 is suspended on a shaft 18 connected to motor 14 and shaft 18 is made up of first and second telescoping sections **18*a* and 18*b*. Section 18*a* is attached to section 18*b* by pin 20 which extends through a closed keyway 22 provided in that end of shaft 18*b* distal operator 12. With reference to the drawings, it will be seen that pin 20 limits movements of section 18*b* with respect to section 18*a*** between a first and second or upper and lower limit.

Figure 3:
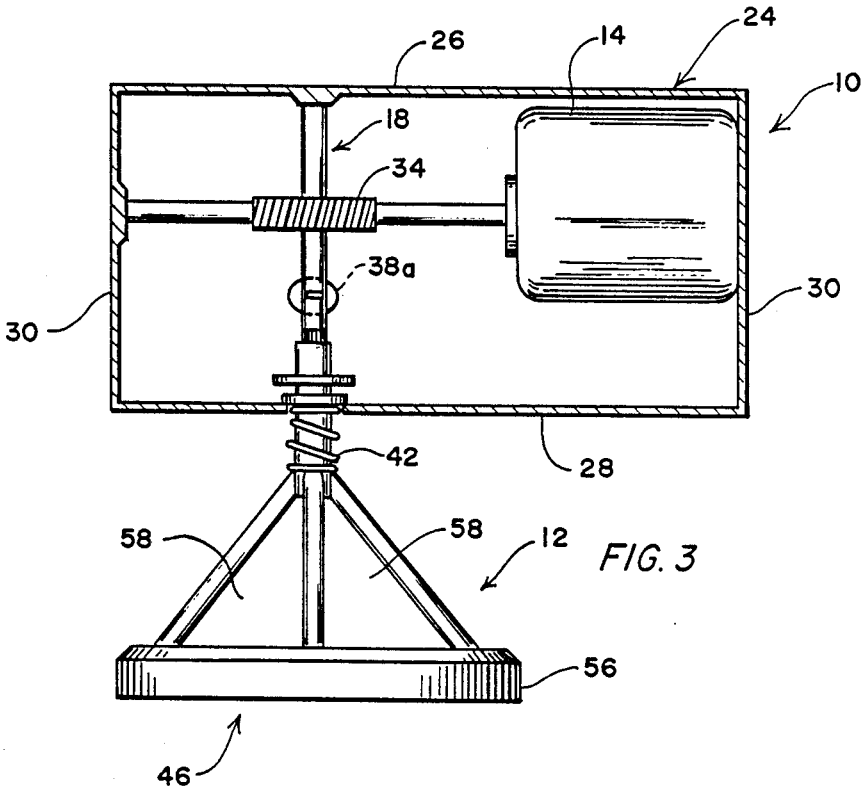
FIG. 3 is a left side view of the opener as shown in FIG. 2.

With continuing reference to FIGS. 1 and 3, a housing 24 is shown as a generally rectangular enclosure with upper and lower walls 26 and 28, respectively, encircled by sidewalls 30. Operator 12 is shown depending below housing 24 but it may be recessed therein if desired. In FIGS. 1 and 3, shaft **18*a* is illustrated as depending from upper wall 26 and is journaled in a bearing 32. Mounted on shaft 18*a* is a toothed gear 34 in mesh with a worm gear 36 which is driven by motor 14. Motor 14 rotates shaft 18*a* in a counterclockwise motion viewing the lid from above but can be reversible, in which case, opener 10 can serve both to remove and to tighten a lid. A pair of lateral side supports 38 provide a bearing 38***a* and bridge shaft 18 between opposing sidewalls 30 and are provided generally intermediate upper and lower walls 26 and 28. That end of shaft 18*b* distal its attachment to shaft 18*a* extends through an aperture with a collar 40 provided in lower wall 28 for attachment to operator 12. A spring biasing means, shown as coil spring 42, is threaded on shaft 18*b* between lower wall 28 and operator 12 biasing shaft 18 to its longest length and pin 20 against the lower limit of keyway 22.

In the embodiment shown, switch 16 is mounted on shaft 18*b* such that movements of operator 12 compressing spring biasing means 42 actuate motor 14. By way of example, this may be accomplished by means of a switch contact ring 44 mounted on shaft 18*b* such that the contact ring actuates or toggles switch 16 on as spring biasing means 42 is compressed and pin 20 is brought against the upper limit of keyway 22 and then toggles the switch off as pressure on the spring biasing means is released.

Generalizing the above, it is essential that motor 14 be operatively connected to operator 12 to cause operator 12 to rotate when motor 14 is actuated. Switch 16 must also be responsive to the user's insertion of a twist-off cap into the recessed opening of operator 12 as more particularly described below and to pressing the cap against the interior surface thereof or releasing the same therefrom.

Figure 4:
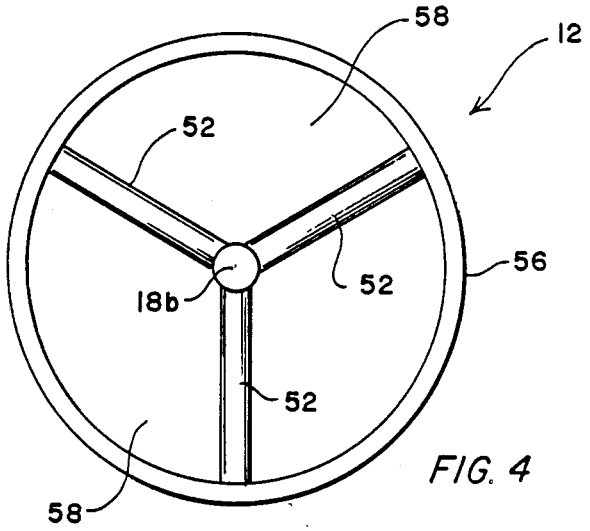
FIG. 4 is a top view of the operator.
Figure 5:
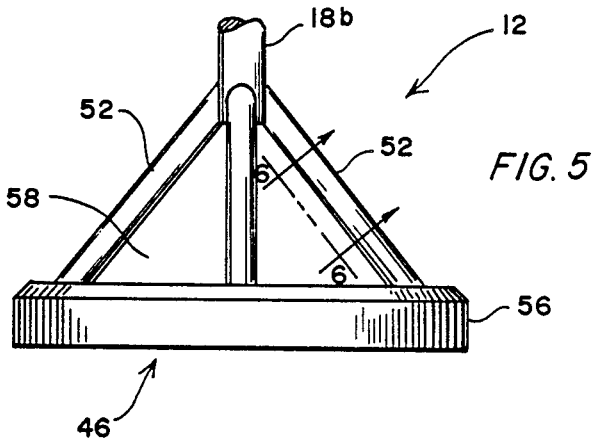
FIG. 5 is a side view of the operator.
Figure 6:
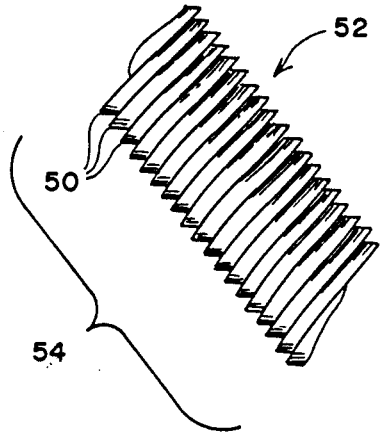
FIG. 6 is taken along line 6—6 in FIG. 5.

Details of a preferred operator 12 are shown in FIGS. 4–6. Referring now to those drawings, operator 1 2 comprises a generally conically shaped body shown attached to motor 14 by agency of shaft 18*b*. Operator 12 may be made detachable from shaft 18*b*, as for example by a set screw (not shown) or the like, such that it can be readily removed for cleaning or for use of the operator as a hand operated opening device. In some instances, on the other hand, operator 12 may be provided as a hand operated opening device without provision for attachment to a motor. In regards to opener 10 which is illustrated in FIGS. 1–6, it has not been found necessary to remove operator 12 for cleaning as there is little reason for it to become soiled.

Operator 12 has a recessed opening 46 which is flared for frictionally engaging larger sized twist-off caps towards outer portions thereof and smaller sized twist-off caps of lesser diameter more deeply therein to the end that the opener is capable of accommodating a range of cap sizes found in a kitchen without need for changing the operator. Recessed opening 46 is provisioned with an interior exposed surface having teeth 48 facing the interior of the operator with their tips 50 slanted towards the apex of the operator providing positive gripping means and resisting removal of a cap pressed therein. It is preferred that the interior exposed surface be only partly covered with teeth 48 to facilitate removal of a cap after it has been separated from a container and for this purpose teeth 48 are preferably located on toothed portions 52 radiating from the apex of the operator and spaced from each other to permit access to the cap for dislodging it as more particularly described below. It is intended that the term radiating be understood in a generalized sense to include continuous and discontinuous strips, spirals or the like and teeth 48 may consist of ridges or serrations which may be arranged in rows on toothed portions 52 and the rows can be slanted towards the apex of the operator. Toothed portions 52 may widen as they approach the flared end of the cone operator and teeth 48 may be longitudinally disposed. In the preferred embodiment shown in FIGS. 4–6, three equally spaced toothed portions 52 have been found entirely adequate with teeth 48 radiating in a helix 54 which for convenience of manufacture is shown as a continuous spiral tangential to the interior exposed surface.

A support structure for toothed portions 52 may be provided such as ring 56 attached to and containing their otherwise free end. Other support structures will be apparent to those skilled in the art. When operator 12 is designed to hold a twist-off cap after it has been removed from a container, some provision must be made for releasing the cap. This can be accomplished by providing one or more open sectors 58 in the conically shaped body of operator 12 between toothed portions 52 to permit access to the cap for dislodging same from the operator after the cap has been twisted off the container.

At the beginning of a duty cycle, switch 16 has motor 14 off. A user with a twist-off cap on a container in need of being opened, inserts the cap into the open end of operator 12. He then pushes the lid into engagement with toothed portions 52 with sufficient force to turn motor 14 on wedging the cap into the operator where it is positively gripped and held by teeth 48. Motor 14 then causes operator 12 to rotate thus twisting off the cap. When the cap has been separated from the container, the user releases the pressure against operator 12 causing switch 16 to turn motor 14 off. When the cap is caught in the operator between toothed portions 52, the user can direct his complete attention to the contents of the container being opened and can tap the lid out of the opener through open sector 58 whenever it is convenient to do so.

In the embodiment illustrated, twist-off cap opener 10 is designed for advantageous attachment as a space saving under-the-counter cabinet appliance to eliminate kitchen counter clutter. It is to be understood, however, that the opener may be wall mounted, mounted on a stand or hand held and modified accordingly as necessary for the particular mounting arrangement as will readily occur to one skilled in the art.

In view of the above, it will be seen that the several objects of the invention are achieved and other advantageous results attained. For example, it is seen that the present machine provides a means for opening a twist-off cap wherein the user has both hands free to hold the container being opened and wherein the lid is held in the device after it has been separated from the container and the opener can be engaged by simply pressing the lid into the device. As various changes could be made in the above described construction without departing from the scope of the invention, it is intended that all matter contained in the above description shall be interpreted as illustrative and not in a limiting sense.

What is claimed:

1. A motorized kitchen-appliance type opener for removing twist-off caps having a range of diameters found in a kitchen from containers without need for manual twisting of same and allowing the user to have both hands free to hold the container during the cap removal operation, said opener comprising:

(a) an operator having a generally conically shaped body with a recessed opening having a partially toothed interior exposed surface, said toothed portions facing the interior and radiating from the apex of the operator, the recessed opening being flared for receiving and frictionally engaging larger sized twist-off caps towards outer portions thereof and smaller sized twist-off caps of lesser diameter more deeply therein whereby said opener accommodates a range of cap sizes found in a kitchen without need for changing said operator;

(b) a motor operatively connected to said operator to cause rotative movement thereof when said motor is actuated; and, (c) a switch for turning said motor on or off responsive to the user's insertion of the twist-off cap into said recessed opening and pressing the cap against the surface thereof, or releasing the same therefrom.

2. The opener of claim 1 wherein the tips of the teeth on the toothed portions of the operator are slanted towards the apex of the operator.

3. The opener of claim 2 wherein the operator has an open sector in the conically shaped body between adjacent toothed portions to permit access to the cap for dislodging same from the operator after the cap has been twisted off the container.

4. The opener of claim 3 wherein the teeth of said toothed portions of the operator are arranged in rows.

5. The opener of claim 4 wherein the rows of teeth are slanted towards the apex of the operator.

6. The opener of claim 5 wherein the rows of teeth are spiraled in a helix tangential to said interior exposed surface.

7. The opener of claim 3 wherein the toothed portions are generally equally spaced about the interior exposed surface.

8. A motorized kitchen-appliance type opener for removing twist-off caps having a range of diameters found in a kitchen from containers without need for manual twisting of same and allowing the user to have both hands free to hold the container during the cap removal operation, said opener comprising:

(a) an operator having a generally conically shaped body with a recessed opening having a partially toothed interior exposed surface, said toothed portions facing the interior and radiating from the apex of the operator and having an open sector in the conically shaped body between adjacent toothed portions to permit access to the cap for dislodging same from the operator after the cap has been twisted off the container, the recessed opening being flared for receiving and frictionally engaging larger sized twist-off caps towards outer portions thereof and smaller sized twist-off caps of lesser diameter more deeply therein whereby said opener accommodates a range of cap sizes found in a kitchen without need for changing said operator and whereby a cap held in the operator can be accessed through the open sector in the conically shaped body;

(b) a motor operatively connected to said operator to cause rotative movement thereof when said motor is actuated; and, (c) a switch for turning said motor on or off responsive to the user's insertion of the twist-off cap into said recessed opening and pressing the cap against the surface thereof, or releasing the same therefrom.

9. The opener of claim 8 wherein the tips of the teeth on the toothed portions of the operator are slanted towards the apex of the operator.

10. The opener of claim 9 wherein the toothed portions are generally equally spaced about the interior exposed surface.

* * * * *